United States Patent [19]

Proctor

[11] Patent Number: 4,846,060

[45] Date of Patent: Jul. 11, 1989

[54] PRINTING WEB TENSIONING SYSTEM

[75] Inventor: Earl M. Proctor, Des Moines, Iowa

[73] Assignee: IOTEC Manufacturing, Inc., Des Moines, Iowa

[21] Appl. No.: 223,790

[22] Filed: Jul. 25, 1988

[51] Int. Cl.[4] ..... B41F 13/54

[52] U.S. Cl. ..... 101/228; 226/11; 226/45; 200/61.18; 34/49

[58] Field of Search ..... 101/219, 225, 226, 228; 226/11, 45; 200/61.18; 34/48, 45

[56] References Cited

U.S. PATENT DOCUMENTS

| | | | |
|---|---|---|---|
| 3,016,622 | 1/1962 | Gade et al. | 34/48 |
| 3,085,347 | 4/1963 | Justus | 34/49 |
| 3,087,663 | 4/1963 | Anderson | 101/228 |
| 3,317,734 | 5/1967 | Martin, Jr. | 226/11 |
| 3,429,491 | 2/1969 | Windley | 226/11 |
| 3,452,853 | 7/1969 | Mabon | 226/45 |
| 3,605,618 | 9/1971 | Clasen | 101/228 |
| 3,638,568 | 2/1972 | Granger | 101/219 |
| 3,823,282 | 7/1974 | Bregar et al. | 200/61.18 |
| 3,823,283 | 7/1974 | Larson | 200/61.18 |
| 3,919,561 | 11/1975 | Coberley | 250/561 |
| 3,928,844 | 12/1975 | Meihofer | 226/11 |
| 3,949,856 | 4/1976 | Ulber et al. | 226/11 |
| 4,078,487 | 3/1978 | McComb | 101/228 |
| 4,508,033 | 4/1985 | Fischer | 101/228 |
| 4,532,500 | 7/1985 | Henu | 226/11 |
| 4,577,109 | 3/1986 | Hirschfeld | 250/461.1 |
| 4,667,946 | 5/1987 | Taguchi et al. | 226/11 |

*Primary Examiner*—E. H. Eickholt

*Attorney, Agent, or Firm*—Henderson & Sturm

[57] ABSTRACT

A printing web tensioning system that is activated in response to a break in the printing web. The system includes a pair of tensioning rollers which bracket the paper web and are movable between a spaced disengaged position and a contacting engaged position. The pair of tensioning rollers are driven by a variable speed motor, the speed of which is synchornized with the speed of the printing cylinders. Hydraulic rams are attached to the tensioning rollers to move them from the disengaged position to the engaged position when a break in the printing web is detected and the printing unit begins to shut down. Since the speed of the tensioning rollers is synchronized with the speed of the printing cylinders, web tension is maintained and a small quantity of paper web is advanced forward and collects on the floor during the shut down process. By maintaining tension on the printing web, paper is prevented from wrapping around the printing cylinders and causing damage to the print blankets.

4 Claims, 2 Drawing Sheets

PRINTING WEB TENSIONING SYSTEM

TECHNICAL FIELD

This invention relates to printing web tensioning devices and more particularly to web tensioning devices actuated by a break in the printing web.

BACKGROUND ART

Printing presses produce quality reproductions on paper webs traveling through the press at high speeds. Care must be taken to maintain the integrity of the web since a break in the rapidly moving web releases the tension exerted on the paper web to pull it through the printing unit. When this occurs, the web jams the printing press causing damage to the fragile print blankets and lengthy down time associated with cleanup, repair, and restringing the paper web through the printing units.

Typically available web break detectors sense the web break, shear the paper web immediately downstream of the printing unit, and shut down the printing unit. However, during the lag time between sensing the break and shut down, the paper web may wrap up on the printing cylinders and damage the print blanket.

Those concerned with these and other problems recognize the need for an improved printing web tensioning system to maintain tension on the web during the shut down process.

DISCLOSURE OF THE INVENTION

The present invention provides a printing web tensioning system that is activated in response to a break in the printing web. The system includes a pair of tensioning rollers which bracket the paper web and are movable between a spaced disengaged position and a contacting engaged position. The pair of tensioning rollers are driven by a variable speed motor, the speed of which is synchronized with the speed of the printing cylinders. Hydraulic rams are attached to the tensioning rollers to move them from the disengaged position to the engaged position when a break in the printing web is detected and the printing unit begins to shut down. Since the speed of the tensioning rollers is synchronized with the speed of the printing cylinders, web tension is maintained and a small quantity of paper web is advanced forward and collects on the floor during the shut down process. By maintaining tension on the printing web, paper is prevented from wrapping around the printing cylinders and causing damage to the print blankets.

An object of the present invention is the provision of an improved printing web tensioning system.

Another object is to provide a printing web tensioning system actuated by a break in the printing web.

A further object of the invention is the provision of a printing web tensioning system that minimizes down time and damage resulting from web breaks.

Still another object is to provide a printing web tensioning system that is inexpensive to manufacture and install.

A still further object of the present invention is the provision of a printing web tensioning system that is durable and easy to maintain.

Other objects, advantages and novel features of the present invention will become apparent from the following detailed description of the invention when considered in conjunction with the accompanying drawings.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
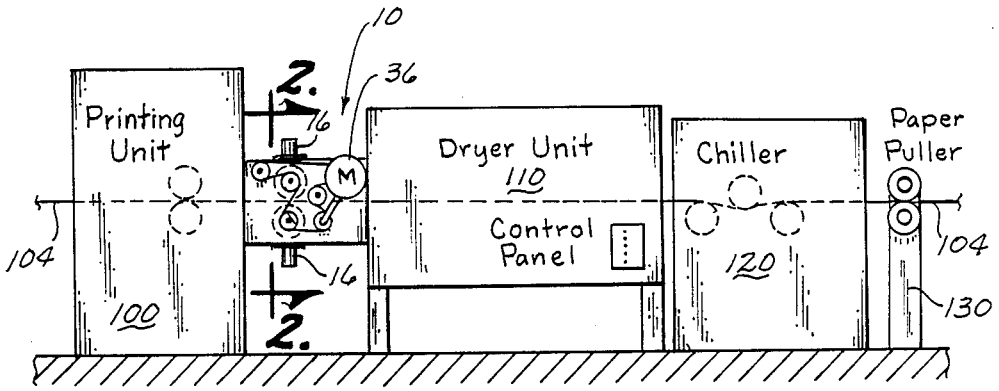
FIG. 1 is a side elevational view showing the printing web's path of travel from the printing unit, and showing the printing web tensioning system installed immediately downstream from the printing unit.
Figure 4:
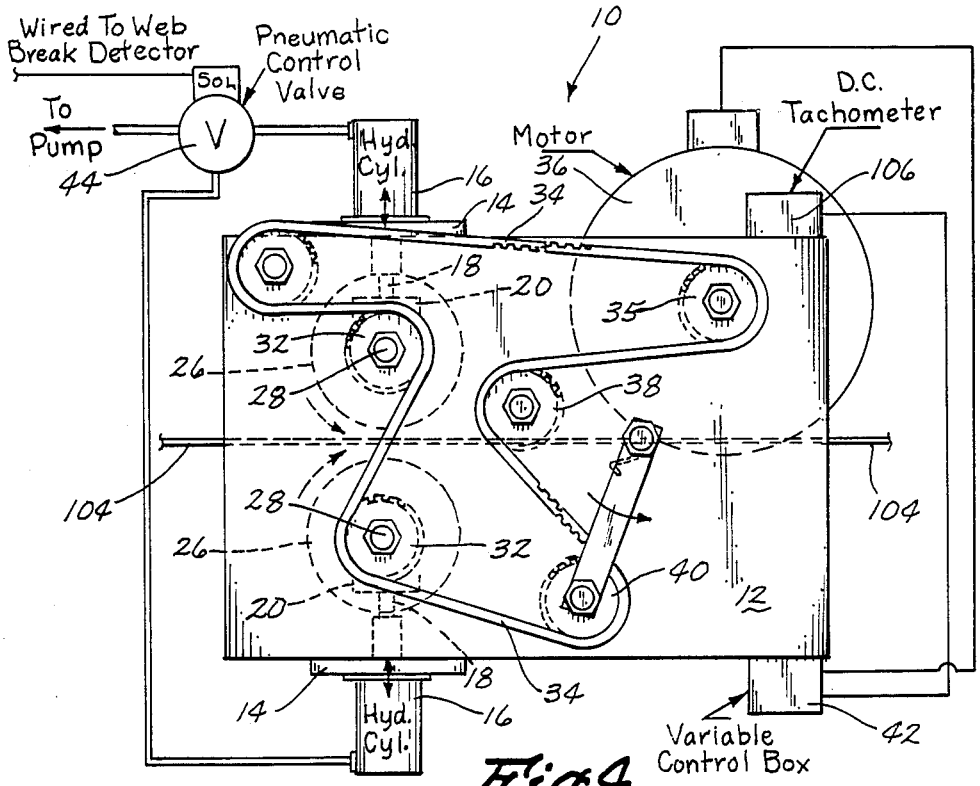
FIG. 4 is an enlarged side elevational view illustrating the printing web tensioning device in the disengaged mode where the rollers are in a spaced relationship to the paper web.

Referring now to the drawings, wherein like reference numerals designate identical or corresponding parts throughout the several views, FIG. 1 shows the printing web tensioning system (10) of the present invention installed immediately downstream from a printing unit (100). The printing unit (100) includes a number of printing cylinders (102) that carry detachable printing blankets (not shown) for reproducing images on a traveling paper web (104). The printing cylinders are driven at a predetermined speed which is recorded by a press DC tachometer (106) (FIG. 4). Although various equipment configurations are possible, FIG. 1 illustrates the printing web tensioning system (10) positioned upstream of a dryer unit (110), a chiller unit (120), and a conventional paper puller or tensioning device (130).

Figure 2:
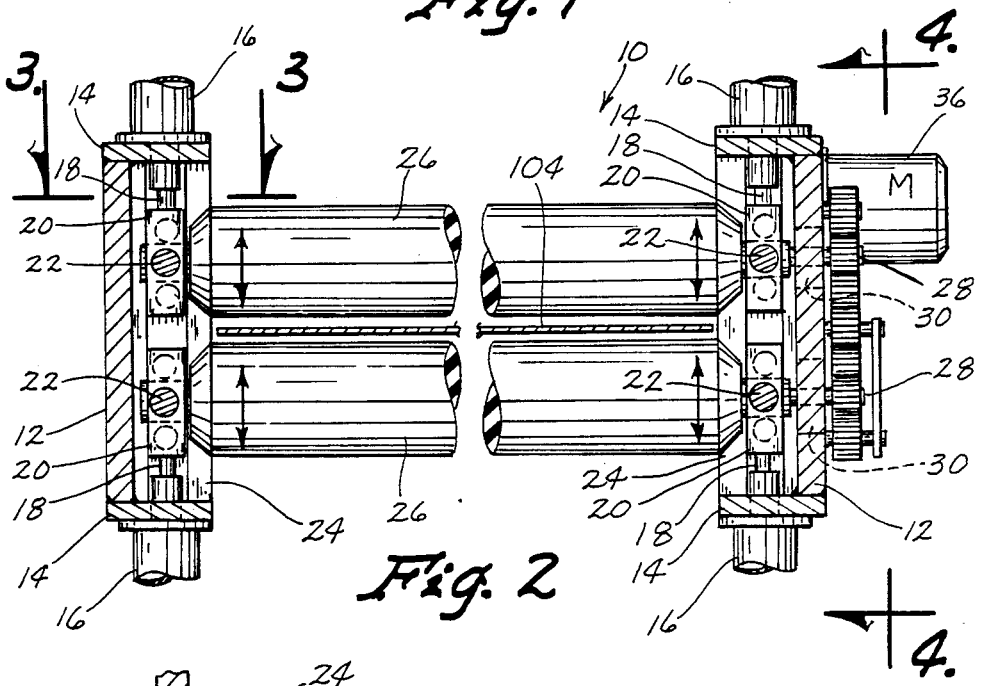
FIG. 2 is a sectional elevation view taken along line 2–2 of FIG. 1, illustrating the position of the tensioning rollers with respect to the paper web.
Figure 3:
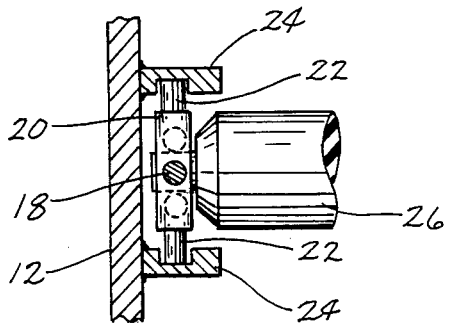
FIG. 3 is a sectional top plan view taken along line 3–3 of FIG. 2 showing the mounting structure at the end of a tensioning roller.

As best shown in FIGS. 2–3, the print web tensioning system (10) is attached to the printing unit (100) by an opposing pair of mounting plates (12). Both the top and bottom of each plate (12) supports a horizontal bar (14) that carries a double acting hydraulic ram (16). The rod (18) of each ram (16) is attached to a bearing block (20). Each block (20) includes horizontal tabs (22) that engage slots in opposing channels (24), thus providing for vertical movement of the blocks (20) as the rods (18) are extended and retracted. A pair of tensioning rollers (26) are secured to and rotatably mounted within the bearing blocks (20). The tensioning rollers (26) are vertically movable with respect to the printing web (104) as illustrated by the directional arrows in FIG. 2. One end of each tensioning roller (26) includes a keyed shaft (28) that extends through slots (30) in the mounting plate (12).

Figure 5:
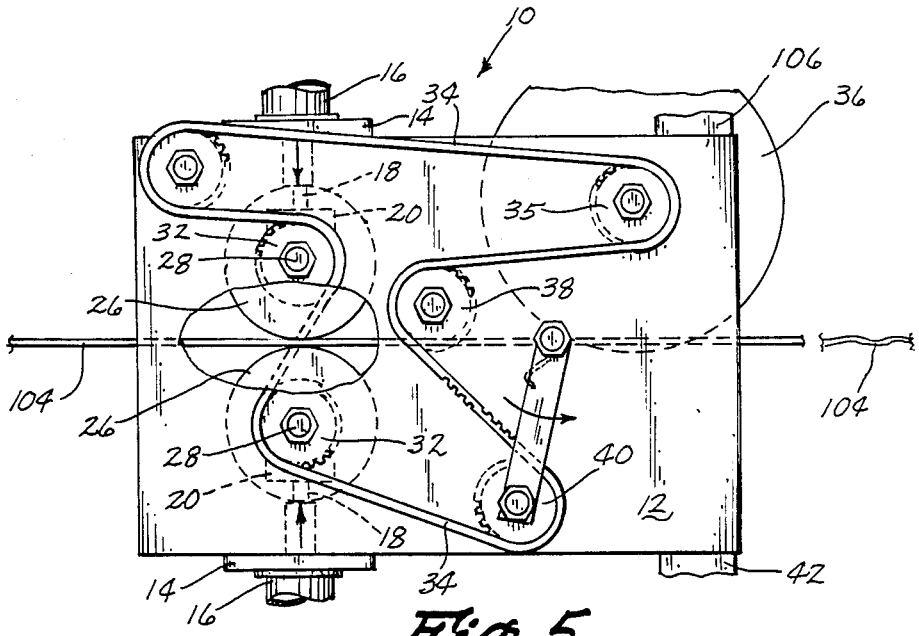
FIG. 5 is an enlarged side elevational view similar to FIG. 4 but showing the printing web tensioning device in the engaged mode where the tensioning rollers contact the paper web and exert tension on the web to pull it forward.

Referring now to FIGS. 4–5, it can be seen that each keyed shaft (28) carries a driven pulley (32) which receives an endless chain or belt (34). The belt (34) is driven by the drive pulley (35) of a variable speed electric motor (36). The belt (34) is also disposed to engage adjustable idler pulleys (38) and spring biased belt tensioning pulley (40). The motor (36) is electronically tied into the press DC tachometer (106) through a variable control box (42). When the printing cylinders (102) come up to ten percent of its normal operating speed, the motor (36) is synchronized with the printing cylinder speed. The hydraulic rams (16) are electronically tied into the press web break detector through a pneumatic control valve (44).

In operation, the printing web tensioning device (10) acts to maintain the tension on the printing web (104) from the time a break is detected by the web break detector until the printing unit (100) is shut down. When the printing unit (100) is starting up and reaches ten percent speed, the variable speed motor (36) is controlled by the press DC tachometer so that the speed of the tensioning rollers (26) is synchronized with the press speed. When a printing web break is detected, the pneumatic control valve (44) is operated to extend the rods (18) of the hydraulic rams (16) thus causing the tensioning rollers (26) to move from the spaced unengaged mode (FIG. 4) to the contacting engaged mode (FIG. 5). Since the speed of the tensioning rollers (26) is synchronized with the press speed, tension is maintained in the printing web (104) to pull it forward and damage to the printing blanket and downtime are minimized.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. A printing web tensioning system for use with a printing unit including rotating printing cylinders, a moving paper web disposed in contact with said printing cylinders, means for monitoring the speed of said rotating print cylinders and said moving paper web, and a web break detector for detecting a break in said paper web and shutting down said printing unit, the printing web tensioning system comprising:

a pair of tensioning rollers attached to said printing unit downstream of said printing cylinders, one of said pair of tensioning rollers being disposed on each side of said moving paper web, said tensioning rollers being movable between a disengaged position wherein said tensioning rollers are spaced from said paper web and an engaged position wherein said tensioning rollers are contacting and exerting tension on said paper web;

a variable speed drive operably attached to said pair of tensioning rollers, said drive being electronically attached to said speed monitoring means such that the speed of said drive is synchronized with the speed of said printing cylinders; and means for moving said pair of tensioning rollers from said disengaged position to said engaged position when a break in said paper web is detected.

2. The system of claim 1 wherein said speed monitoring means includes a press tachometer.

3. The system of claim 1 wherein said tensioning roller moving means includes hydraulic rams electronically coupled to said web break detector through a pneumatic control valve.

4. The system of claim 2 wherein said variable speed drive is synchronized with the speed of said printing cylinders when said printing cylinders reach ten percent of normal operating speed.

* * * * *